US006183547B1

(12) United States Patent
Miller et al.

(10) Patent No.: US 6,183,547 B1
(45) Date of Patent: Feb. 6, 2001

(54) ENVIRONMENTALLY ACCEPTABLE INHIBITOR FORMULATIONS FOR METAL SURFACES

(75) Inventors: Albert E. Miller, Granger, IN (US); Gautam Banerjee, Mesa, AZ (US)

(73) Assignee: The University of Notre Dame du Lac, Notre Dame, IN (US)

( * ) Notice: Under 35 U.S.C. 154(b), the term of this patent shall be extended for 0 days.

(21) Appl. No.: 09/263,712

(22) Filed: Mar. 5, 1999

Related U.S. Application Data

(60) Provisional application No. 60/076,853, filed on Mar. 5, 1998.

(51) Int. Cl.[7] ..... C23C 22/05; C09D 5/08; C23F 11/00

(52) U.S. Cl. ..... 106/14.21; 106/14.14; 106/14.44; 148/243; 148/264; 252/387; 252/389.53; 427/372.2; 427/383.7; 428/457; 428/469; 428/472

(58) Field of Search ..... 106/14.14, 14.21, 106/14.44; 148/243, 264; 427/372.2, 383.7; 428/457, 469, 472; 252/387, 389.53

(56) References Cited

U.S. PATENT DOCUMENTS 3,720,588 * 3/1973 Oleson et al. ..... 205/285
4,913,849 * 4/1990 Husain ..... 376/310
4,935,058 * 6/1990 Helmstetter ..... 106/14.11
5,068,059 * 11/1991 Go et al. ..... 252/389.53
5,093,073 * 3/1992 Schenker ..... 376/310
5,292,455 * 3/1994 Zefferi et al. ..... 252/389.23

* cited by examiner

*Primary Examiner*—Anthony Green
(74) *Attorney, Agent, or Firm*—Barnes & Thornburg

(57) ABSTRACT

A composition for inhibiting corrosion of metal surfaces comprises permanganate and a very low concentration of chromium (VI). The concentration of chromium (VI) in the aqueous solution is less than about 100 micrograms per liter, and the concentration of permanganate is about 0.2% to about 20% by weight of the aqueous solution. In another embodiment of the invention, a composition for inhibiting corrosion of metal surfaces includes permanganate and acetic acid. The concentration of acetic acid in the aqueous solution is between about 0.2% and 2.0% by volume. The concentration of permanganate is about 0.2% to about 20% by weight of the aqueous solution. Other embodiments of the invention include methods of using the present sealant compositions and the resulting corrosion inhibited metal substrates. In yet another embodiment of the present invention there is provided a kit for preparing corrosion inhibiting solutions for metal treatment.

27 Claims, 6 Drawing Sheets

ENVIRONMENTALLY ACCEPTABLE INHIBITOR FORMULATIONS FOR METAL SURFACES

This application claims the benefit of U.S. Provisional Application No. 60/076,863 filed Mar. 5, 1998.

FIELD OF INVENTION

This invention relates to a composition and a method for inhibiting the corrosion of metal surfaces. More specifically, this invention is directed to a composition comprising permanganate and either an organic acid or a low concentration of chromium (VI) and to a method for using the composition for forming a corrosion inhibiting coating on a metal surface.

BACKGROUND AND SUMMARY OF THE INVENTION

Coatings comprising chromium (VI) oxides are known to inhibit corrosion of metal surfaces. Chromium (VI) oxides are the active species in so called chromium conversion coatings; i.e. they serve as a sacrificial cathode. Chromium conversion coatings are formed by the deposition of chromium (VI) species along with a chromium (III) species on the surface of a metal substrate, for example, on the surface of an anodized aluminum alloy. While the aluminum oxide layer of anodized aluminum is substantially inert, the aluminum oxide layer is porous and must be sealed to provide optimum protection of the underlying aluminum substrate. Chromium (VI) conversion coatings provide excellent "seal coats" for anodized aluminum surfaces. Although chromium (VI) has excellent corrosion inhibiting characteristics, it is also a known carcinogen. Current EPA and OSHA regulations require the chromium content of drinking water to be less than 100 micrograms per liter. Further restrictions on usage of chromium (VI) salts in industrial operations are anticipated. There have been significant research efforts directed to development of new industrial processes to enable more efficient usage of chemical reactants and having by-product/effluent streams with reduced environmental impact. The present invention is directed to a corrosion inhibiting composition and method that enables chromium (VI) based corrosion inhibiting sealant functionality using very low concentrations of chromium or by eliminating chromium (VI) and replacing it with an organic acid.

Thus, there is provided in one embodiment of the present invention an aqueous composition for inhibiting corrosion of metal surfaces. The composition comprises permanganate and a very low concentration of chromium (VI). The concentration of chromium (VI) in the aqueous solution is less than about 100 micrograms per liter, and the concentration of permanganate is about 0.2% to about 20% by weight of the aqueous solution. Surprisingly, the solution can be used to provide metal/metal oxide sealant functionality comparable to chromium (VI) conversion coatings utilizing much higher chromium concentrations.

In another embodiment of the present invention, a composition for inhibiting corrosion of metal surfaces includes permanganate and acetic acid. The concentration of acetic acid in the aqueous solution is between about 0.2% and 2.0% by volume. The concentration of permanganate is about 0.2% to about 20% by weight of the aqueous solution.

Other embodiments of the invention include methods of using the present sealant compositions and the resulting corrosion inhibited metal substrates. In one embodiment, the inhibited metal is the inner surface of a conduit of a recirculating heat transfer system, and the sealant solution is used as the heat transfer medium. In yet another embodiment of the present invention there is provided a kit for preparing a corrosion inhibiting solution for metal treatment. The kit comprises a water soluble compound of chromium (VI) and a water soluble permanganate salt. The weight ratio of chromium (VI) to permanganate in the kit is about $1:2\times10^4$ to about $1:2\times10^8$. A similar kit can be provided for preparing the acetic acid solution.

DETAILED DESCRIPTION OF THE INVENTION

Figure 1:
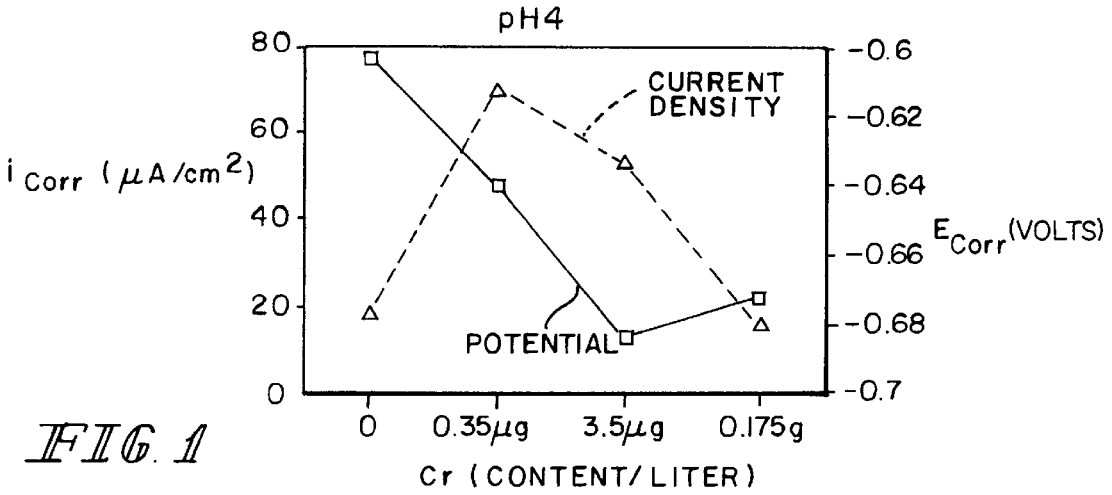
FIGS. 1–3 are graphs illustrating the relationship of the corrosion current density ($I_{corr}$) and the corrosion potential ($E_{corr}$) of Al-2024 in 3% NaCl solutions at a pH of 4, 7, and 10, respectively, to the total chromium (VI) concentration in the sealant solution.
Figure 2:
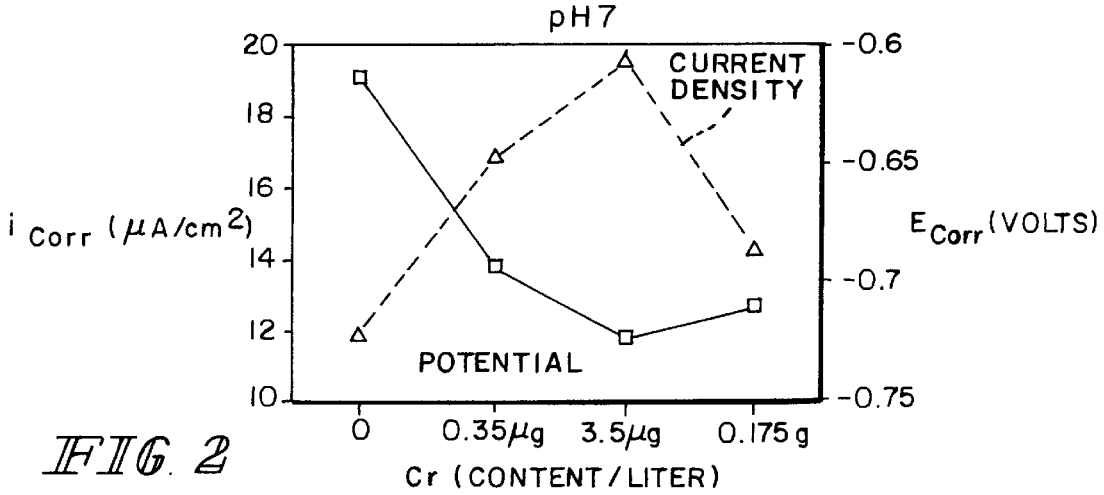
Figure 3:
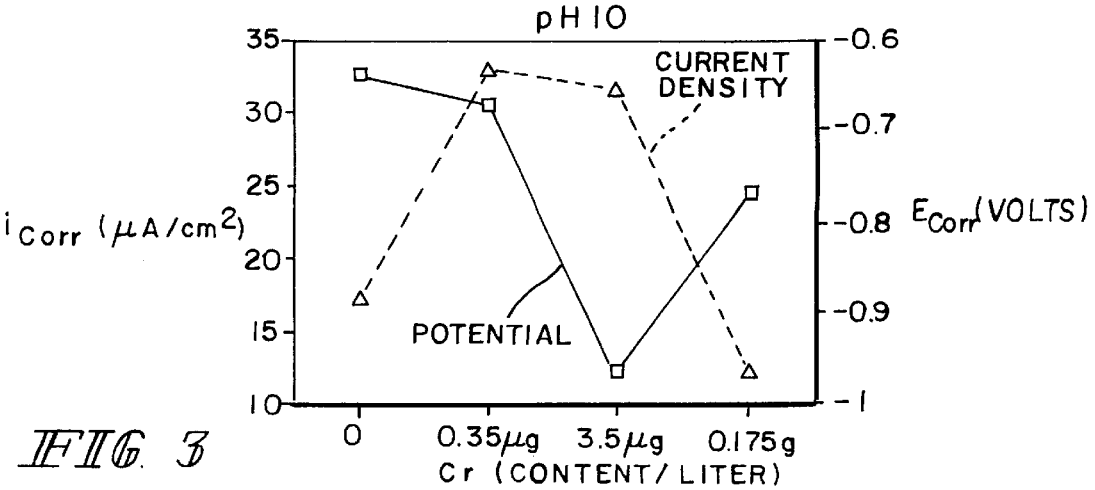
Figure 4:
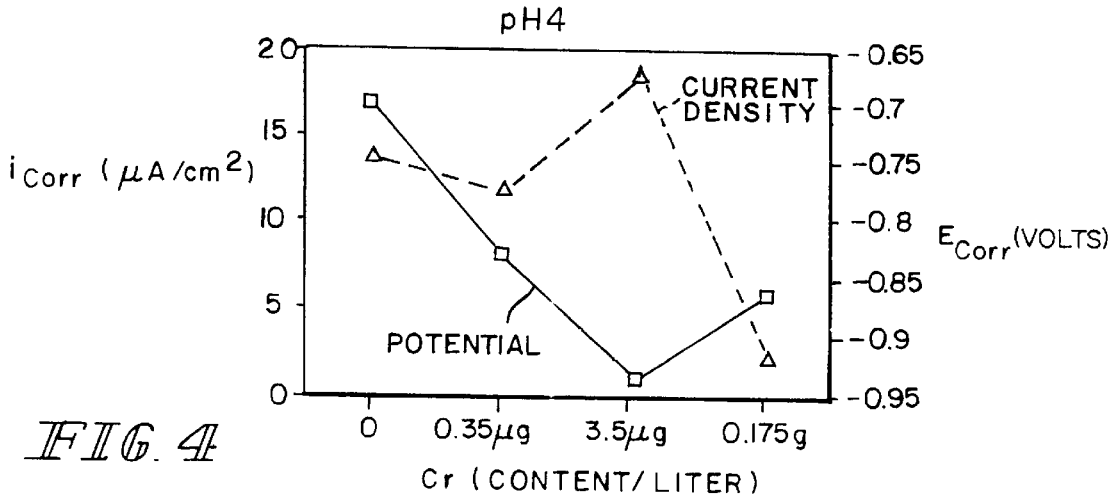
FIGS. 4–6 are graphs illustrating the relationship of the corrosion current density ($I_{corr}$) and the corrosion potential ($E_{corr}$) of Al-606 1 in 3% NaCl solutions at a pH of 4, 7, and 10, respectively, to the total chromium (VI) concentration in the sealant solution.
Figure 5:
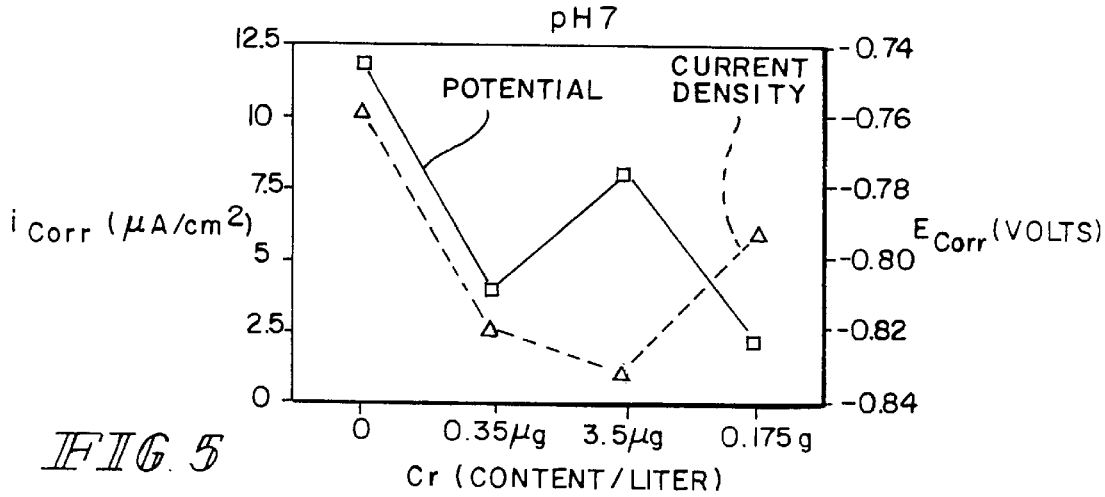
Figure 6:
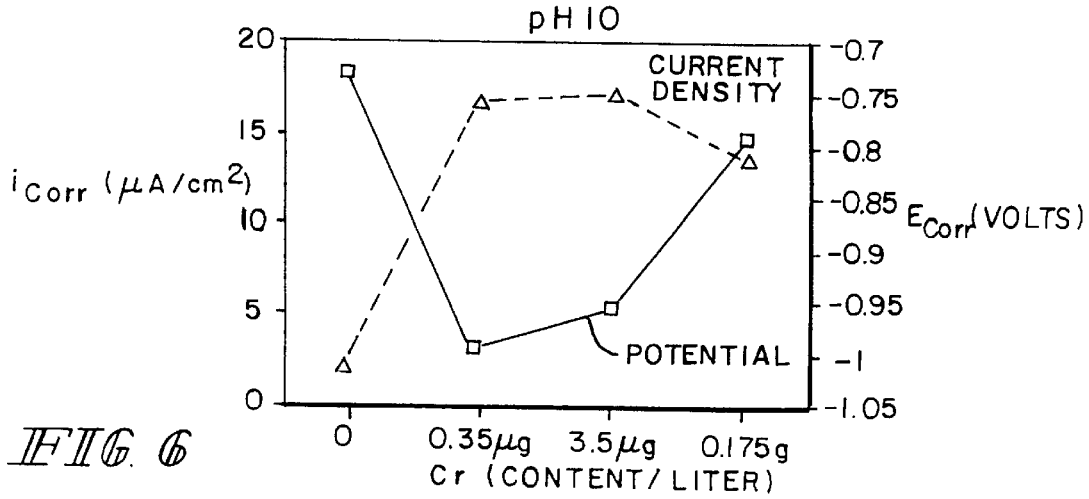
Figure 7:
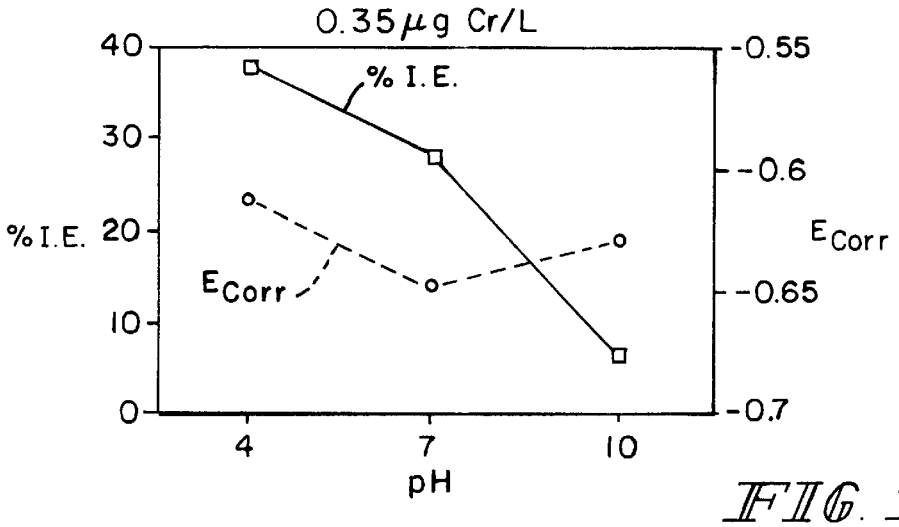
FIG. 7 is a graph illustrating the correlation of the corrosion inhibition efficiency (% I.E.) and the corrosion potential ($E_{corr}$) as a function of pH in 3% NaCl of an Al-2024 treated with an aqueous sealant containing 0.35 $\mu$g/L of chromium (VI) and 3.75% by weight of permanganate to pH in 3% NaCl solution.
Figure 8:
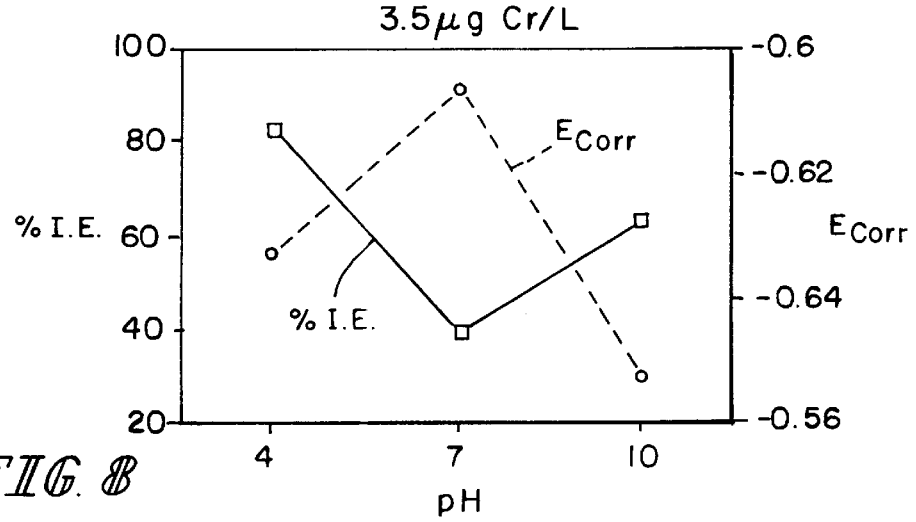
FIG. 8 is a graph illustrating the correlation of the corrosion inhibition efficiency (% I.E.) and the corrosion potential ($E_{corr}$) as a function of pH in 3% NaCl of an Al-2024 treated with an aqueous sealant containing 3.5 $\mu$g/L of chromium (VI) and 3.75% by weight of permanganate to pH in 3% NaCl solution.
Figure 9:
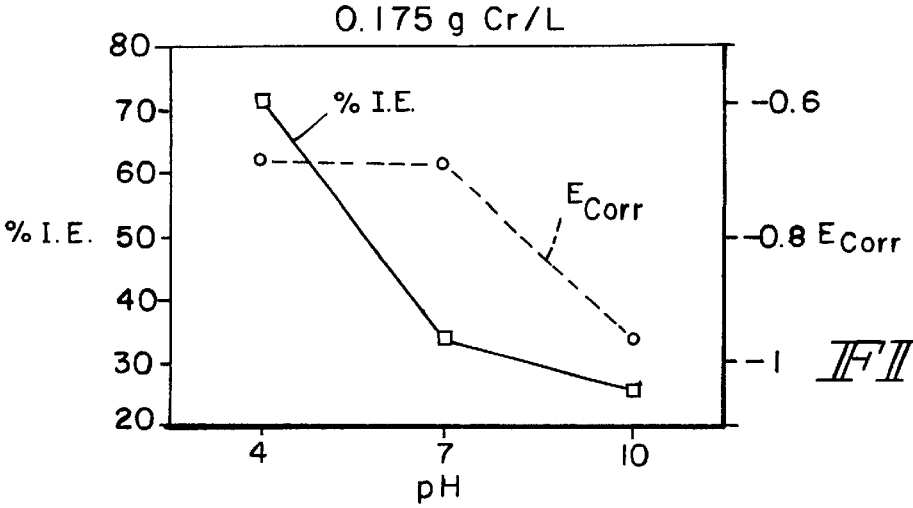
FIG. 9 is a graph illustrating the correlation of the corrosion inhibition efficiency (%I.E.) and the corrosion potential ($E_{corr}$) as a function of pH in 3% NaCl of an Al-2024 treated with an aqueous sealant containing 0.175 g/L of chromium (VI) and 3.75% by weight of permanganate to pH in 3% NaCl solution.
Figure 10:
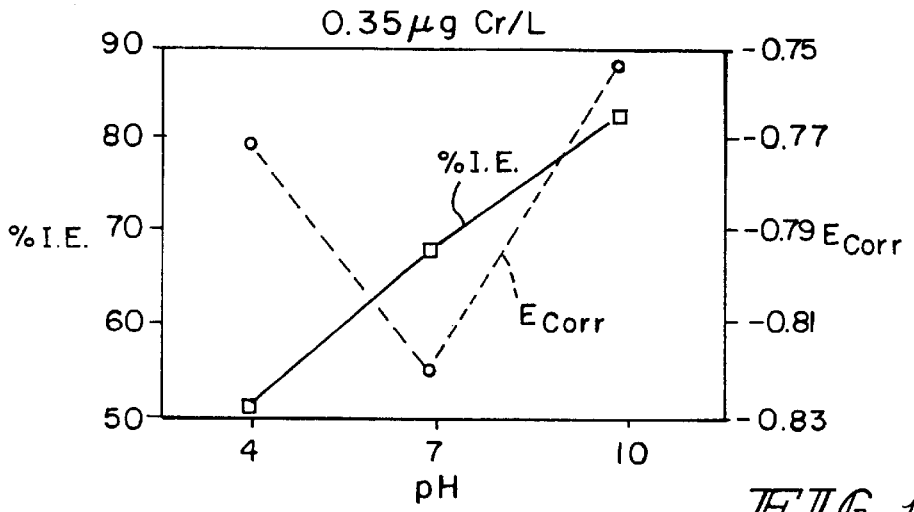
FIG. 10 is a graph illustrating the correlation of the corrosion inhibition efficiency (%I.E.) and the corrosion potential ($E_{corr}$) as a function of pH in 3% NaCl of an Al-6061 treated with an aqueous sealant containing 0.35 $\mu$g/L of chromium (VI) and 3.75% by weight of permanganate to pH in 3% NaCl solution.
Figure 11:
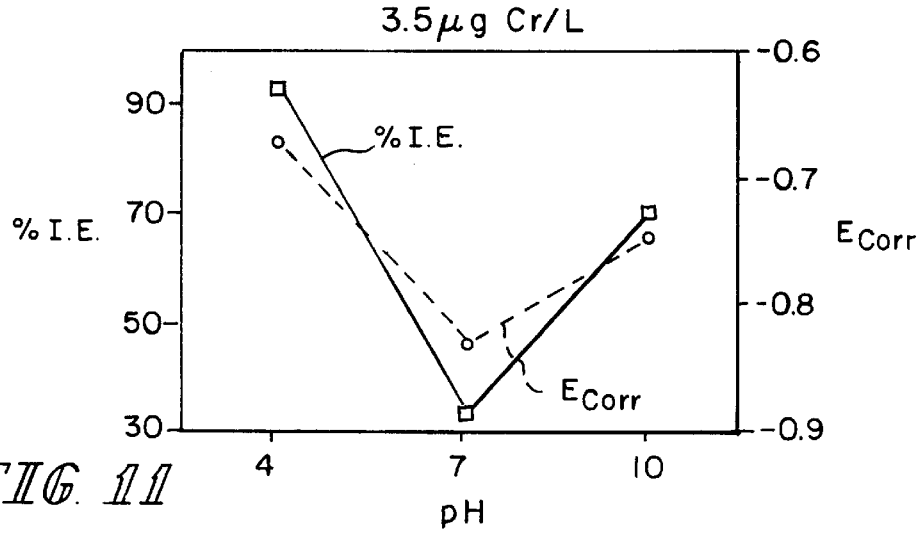
FIG. 11 is a graph illustrating the correlation of the corrosion inhibition efficiency (%I.E.) and the corrosion potential ($E_{corr}$) as a function of pH in 3% NaCl of an Al-6061 treated with an aqueous sealant containing 3.5 $\mu$g/L of chromium (VI) and 3.75% by weight of permanganate to pH in 3% NaCl solution.
Figure 12:
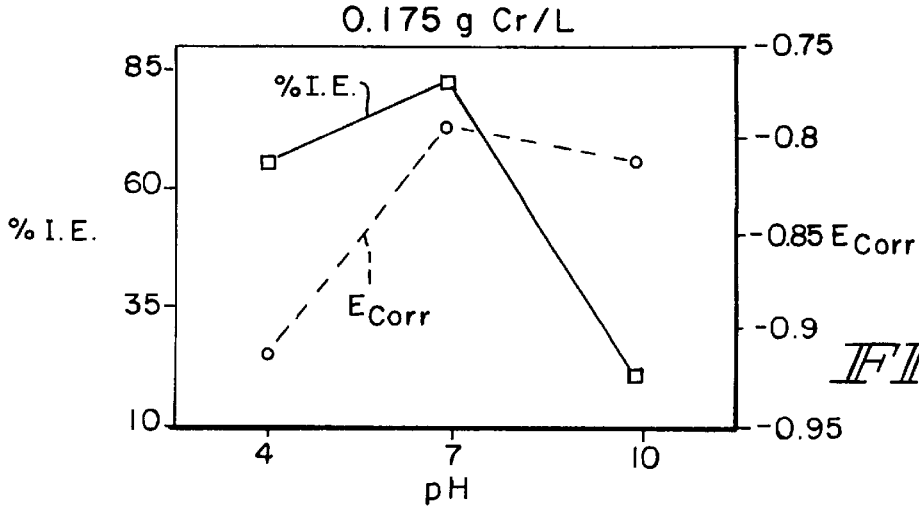
FIG. 12 is a graph illustrating the correlation of the corrosion inhibition efficiency (%I.E.) and the corrosion potential ($E_{corr}$) as a function of pH in 3% NaCl of an Al-6061 treated with an aqueous sealant containing 0.175 g/L of chromium (VI) in 3% NaCl solution.

In one embodiment of this invention there is provided an environmentally friendly composition for inhibiting corrosion of metal surfaces. The composition comprises an aqueous solution of permanganate and a low concentration of chromium (VI). The concentration of permanganate is about 0.2% to about 20% by weight of the solution. The total concentration of chromium (VI) in the aqueous solution is less than about 100 micrograms per liter. Preferably the total concentration of chromium (VI) is about 1 to about 80 micrograms per liter, more preferably about 5 to about 50 micrograms per liter.

Typically the chromium (VI) component is provided as a water soluble chromium (VI) compound, for example, alkali metal dichromates, alkali metal chromates, and chromium trioxide (or chromic acid).

Permanganate concentration in the present metal treatment composition is about 0.2% to about 20% by weight of the solution. The nature of the permanganate salt is not critical provided that it has sufficient water solubility to produce the specified permanganate concentration in water solution. Permanganate salts useful for preparing the present compositions are water soluble alkali metal permanganates such as potassium permanganate, sodium permanganate, or lithium permanganate. The weight ratio of chromium to permanganate (VI) in the present compositions is about $1:2\times10^4$ to $1:2\times10^8$.

The present metal treatment compositions are prepared simply by dissolving appropriate amounts of a water soluble permanganate salt and a water soluble chromium (VI) compound in deionized water to provide a solution having permanganate and the chromium (VI) in the specified concentrations. For example, a 5 weight percent solution of permanganate can be prepared by dissolving 6.67 grams of potassium permanganate in 93.33 grams of water (total solution mass=10 grams). Thereafter, sufficient potassium dichromate is dissolved in the permanganate solution to provide a chromium (VI) concentration of 1.0 microgram per liter.

The present metal treatment composition can include effective amounts of other additives, for example, activator additives, wetting agents or surfactants, and mineral or organic acids, bases and/or buffers for pH adjustment and maintenance. Activator additives include, for example, boric acid or sodium borate. Suitable acids for lowering the pH of the present metal treatment compositions include sulfuric acid, hydrochloric acid, nitric acid or phosphoric acid. A preferred base is ammonium hydroxide; the ammonium ions can be readily eliminated from metal surfaces treated in accordance with this invention simply by drying at elevated temperatures. Typical buffers useful for the present compositions include alkali metal, alkaline tetra- and metaborate, alkali metal carbonates and benzoic acid and alkali metal benzoate. Preferably the pH of the coating composition is about 4 to about 10.

In another embodiment of the present invention there is provided a method for inhibiting corrosion of metal surfaces using the present low chromium anti-corrosion treatment compositions.

Typically, the metal surface is first cleaned to remove contaminants. For example, the surface of a metal substrate can be cleaned with a non-etching alkaline cleaner, an emulsion cleaner, a vapor degreaser, or solvent degreaser to remove organic oils and greases. The metal surface is rinsed with deionized water and optionally polished with phosphoric acid and/or sulfuric acid. Aluminum surfaces can require an alkaline or acid etching treatment, and then desmutting with nitric acid to remove the aluminum oxide coating. The coating composition is applied to the prepared metal surface by any of the commonly used techniques such as spraying, brushing, dipping, roller-coating, reverse roller-coating, and flow coating. In one preferred embodiment the metal surface is immersed in the coating composition for about 5 to about 10 minutes.

In one embodiment, the metal treatment solution for immersing a metal surface is maintained at a temperature of about 30° C. to about 105° C. Preferably the treatment solution is maintained at a temperature of about 95 ° C. to about 105° C. The metal surface is contacted with the treatment solution for about 2 to about 60 minutes. Generally, the higher the temperature of the solution, the shorter the surface-solution contact time for effective corrosion inhibiting treatment. Activators such as sodium borate and boric acid can also be added to the coating composition to decrease the surface-solution contact time for effective corrosion inhibition. Following treatment, the resulting corrosion inhibited metal surface is rinsed with water.

When the metal substrate is anodized aluminum, treatment with the present corrosion inhibiting solution works to fill pores and "seal" the characteristic aluminum oxide coating. Anodized aluminum alloy substrates can be effectively corrosion inhibited in accordance with this invention by immersing the alloy substrate for about 5 to about 10 minutes in an aqueous metal treatment composition of this invention maintained at a temperature of about 95° to about 105°. Alternatively, a corrosion inhibited coating can be formed on an anodized aluminum alloy surface by immersion for about 30 to about 60 minutes in an aqueous low chromium (VI) treatment composition of this invention maintained at about 30° C. The corrosion inhibited alloy surfaces are rinsed and dried, for example, in ambient air, in a stream of oil-free compressed air, or in heated air. The treatment process inhibits the corrosion of aluminum alloy surfaces as determined by ASTM B-117 "Operating Salt Spray Apparatus."

Non-anodized aluminum can also be treated in accordance with this invention to improve corrosion resistance. Typically, the aluminum surface to be treated is first etched with an etching solution to remove the aluminum oxide coating and then contacted with the treatment solution to deposit a corrosion inhibiting coating on the aluminum surface. The corrosion inhibited aluminum surface can optionally be further coated with a powder or paint coating.

Treating a metal surface with the metal treatment composition in accordance with this invention provides a corrosion inhibited surface comprising metal bound chromium (VI) oxides and manganese (VII) oxides. For example, anodized aluminum surface treated by immersion in an aqueous solution comprising about 3.5 micrograms per liter chromium (VI) and about 4.8% by weight of permanganate is provided with a sealing coat comprising chromium (VI) oxides.

Corrosion inhibition of the treated surface was evaluated using electrochemical techniques, i.e., potentiodynamic polarization. The corrosion inhibiting coating provides cathodic protection of the underlying anodized aluminum surface over a pH range of about 4 to about 10. Indeed, preliminary results suggest that the coating provides excellent cathodic protection even above pH 10. The treated anodized aluminum surface inhibits corrosion as determined according to ASTM Standard B-117.

In another embodiment of the invention, acetic acid is substituted for the chromium. A corrosion inhibiting composition prepared according to this embodiment of the invention includes between about 0.2% and 2.0% glacial acetic acid by volume of the solution. Preferably, the concentration is about 0.5% glacial acetic acid by volume. As with the chromium containing solution described above, the concentration of permanganate is about 0.2% to about 20% by weight of the aqueous solution. Again, the solution may be prepared by combining a water soluble form of acetic acid and a water soluble permanganate salt in deionized water to achieve the desired concentrations. As with the solution containing chromium, additives such as wetting agents, buffers and/or bases, as well as other additives, may be added as needed In another embodiment of this invention the above-described corrosion inhibiting metal treatment solutions are used for inhibiting corrosion on metal components of recirculating water systems such as heat transfer systems. For example, the aqueous treatment solution can be used as the heat transfer medium to inhibit the corrosion of carbon steel conduit components in either aerated or deaerated water recirculating systems. In deaerated water recirculating systems, the inhibition efficiency (% I.E.) of an aqueous solution comprising about 3.5 micrograms per liter of chromium (VI) and 3.75 grams per liter of permanganate is 46.3%, while in aerated recirculating water systems, the inhibition efficiency is above 93%. The inhibition efficiency was graphically determined using the Tafel extrapolation method as described in ASTM G3-89 "Standard Practice for Conventions Applicable to Electrochemical Measurements in Corrosion Testing."

Another embodiment of the present invention provides a kit for preparing a corrosion inhibiting solution for metal treatment. The kit comprises a water soluble compound of chromium (VI) and a water soluble permanganate salt. The weight ratio of chromium (VI) to permanganate in the kit is about $1:2\times10^4$ to about $1:2\times10^8$. The chromium (VI) compound and the permanganate salt are premixed and packaged together, or alternatively, the chromium (VI) salt and the permanganate salt are packaged separately for dissolution in a specified volume of water. In another embodiment the chromium (VI) compound and the permanganate salt are provided as standardized stock solutions that can be diluted with a specified volume of water to provide a corrosion inhibiting metal treatment solution. Similar kits can be prepared for the solution containing acetic acid.

EXAMPLE 1

Corrosion Inhibiting Coating on Anodized Aluminum Alloys

Four Al-2024 aluminum coupons and four Al-6061 aluminum coupons were cleaned, degreased, and chemically polished with a solution of 75% phosphoric acid and 25% sulfuric acid. These coupons were desmutted in 1% nitric acid and then rinsed with flowing water. The coupons were anodized in 15% sulfuric acid for 15 minutes at 12 volts DC at 25° using an HP 644B D.C. power supply. One coupon from each of the two sets of anodized aluminum coupons was treated with a sealing solution consisting of either (a) distilled water; (b) an aqueous solution containing 0.175 grams per liter of chromium (VI); (c) an aqueous solution containing 3.5 micrograms per liter chromium (VI) and 3.75 grams per liter of permanganate; (d) an aqueous solution containing 0.35 micrograms per liter of chromium (VI) and 3.75 grams per liter of permanganate. Each of the anodized aluminum coupons was treated with one of the above solutions for five minute at 100° C. to provide "sealed anodized aluminum coupons." The sealed anodized coupons were rinsed in flowing water then air dried. The corrosion inhibition efficiency, %I.E., was evaluated by potentiodynamic polarization according to the procedure described in ASTM G3-89 "Standard Practice for Conventions Applicable to Electrochemical Measurements in Corrosion Testing" in acidic (pH=4), neutral (pH=7), and alkaline (pH=10) 3% NaCl solutions. An EG&G flat cell model K 0234 was used as the corrosion cell, and a Gamry CMS 100 system along with CMS 105 software were used to derive the computer-driven polarization studies. The exposed surface area of each sample was 1 $cm^2$. A saturated calomel electrode (SCE) was used as the reference electrode while a platinum grid electrode was used as the counter electrode. The solutions were deaerated by bubbling oxygen-free nitrogen gas through the solutions The corrosion inhibition efficiency for each coupon was calculated using the formula:

$$\%\ \text{I.E.} = \frac{I_{corr} - {}^{inh}I_{corr}}{I_{corr}} \times 100 \tag{1}$$

Where $I_{corr}$ is the corrosion current density in the absence of inhibitor and ${}^{inh}I_{corr}$ is the corrosion current density in the presence of inhibitor. The current densities were determined graphically according the Tafel extrapolation method described in ASTM G3-89.

The results of the electrochemical measurements are tabulated in Table 1. As can be seen from the Table, the $I_{corr}$ values are dependent on the amount of chromium (VI) present in the coating composition as well as the pH of the 3% NaCl solution. The $I_{corr}$ values obtained for all the coupons that were treated with coating compositions comprising about 0.35 to about 3.5 micrograms per liter of chromium (VI) were significantly lower than the $I_{corr}$ values obtained for aluminum-alloys that were treated with deionized water. The Al-2024 aluminum alloy coupon treated with a coating composition comprising 3.5 micrograms per liter chromium (VI) and 3.75% by weight of permanganate exhibited the highest corrosion inhibition efficiency regardless of the pH; the results for the Al-6061 aluminum alloy coupon treated with the same coating composition varied with pH. Generally the $I_{corr}$ values are lowest in the 3% NaCl solutions at a pH=7. The potentiodynamic polarization results are presented graphically in FIGS. 1–12.

EXAMPLE 2

Corrosion Inhibiting Coatings on Carbon Steel

Figure 13:
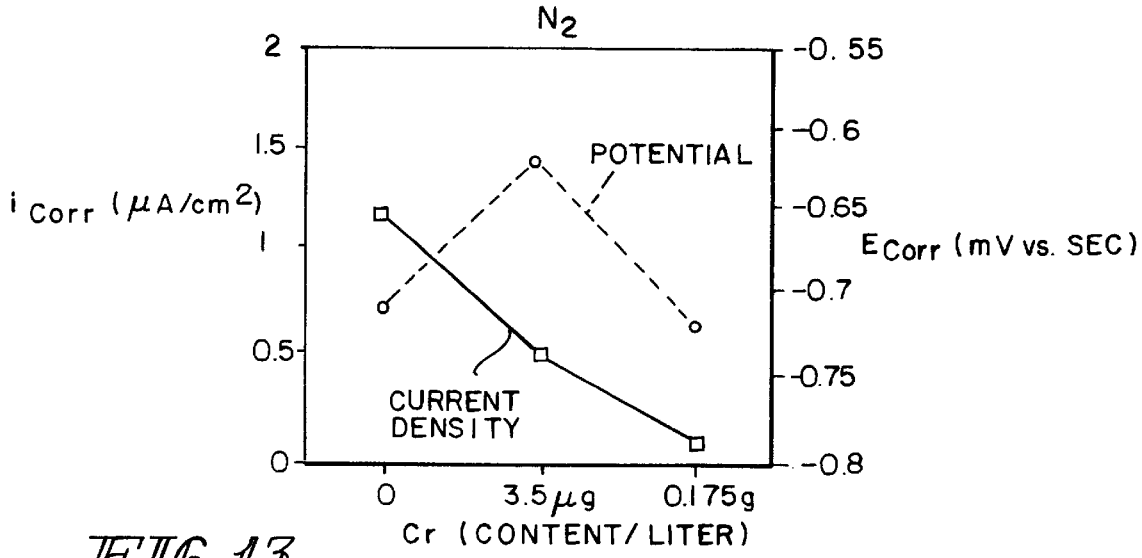
FIG. 13 is a graph illustrating the corrosion current density ($I_{corr}$) and corrosion potential ($E_{corr}$) for carbon steel in deaerated, 3% NaCl solutions that included no chromium (VI), 3.5 lg/L chromium (VI) and 3.75% by weight of permanganate, and 0.175 g/l chromium (VI), respectively.
Figure 14:
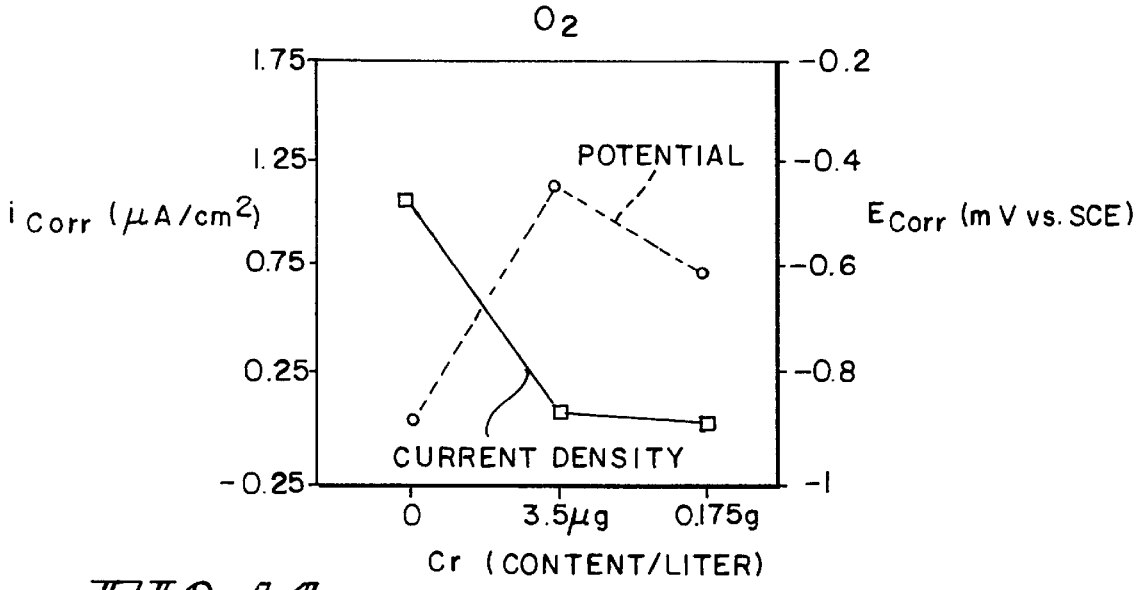
FIG. 14 is a graph illustrating the corrosion current density ($I_{corr}$) and corrosion potential ($E_{corr}$) for carbon steel in aerated, 30/oNaCI chloride solutions that included no chromium (VI), 3.5 $\mu$g/L chromium (VI) and 3.75% by weight of permanganate, and 0.175 g/l chromium (VI), respectively.

Commercial grade steel coupons were washed to provide clean carbon steel coupons. The clean carbon steel coupons were immersed in either (a) a distilled water solution containing 3% by weight NaCl; (b) an aqueous solution containing 0.175 grams per liter of chromium (VI) and 3% by weight sodium chloride; or (c) an aqueous solution containing 3.5 micrograms per liter of chromium (VI), 3.75 grams per liter of permanganate and 3% by weight sodium chloride. The inhibition efficiency %I.E. was evaluated using potentiodynamic polarization according to the procedure described in ASTM G3-89 described above. An EG&G flat cell model K 0234 was used as the corrosion cell, and a Gamry CMS 100 system along with CMS 105 software were used to derive the computer-driven polarization studies. The exposed surface area of each sample was 1 $cm^2$. A saturated calomel electrode (SCE) was used as the reference electrode while a platinum grid electrode was used as the counter electrode. The %I.E. in each solution was evaluated both in the presence of oxygen and in the absence of oxygen. The solutions were aerated by bubbling air (80% by weight $N_2$ and 20% by weight $O_2$ ) through the solutions or deaerated by bubbling oxygen-free nitrogen gas through the solutions. The results from the potentiodynamic polarization test are tabulated in Table 2. As can be seen from Table 2, not only did the $I_{corr}$ values change depending upon the amount of chromium (VI) present in the solution, but the $I_{corr}$ was also dependent on the dissolved gases. In the aerated solutions the inhibition efficiency was reduced from 97.8% for coupons treated with solutions containing about 0.175 grams per liter of chromium (VI) to about 93.6% for coupons treated with solutions containing about 3.5 micrograms per liter of chromium (VI). In the deaerated solutions, the inhibition efficiency decreased from 91.3% for coupons treated with solutions containing about 0.175 grams per liter of chromium (VI) to about 46.3% for coupons treated with solutions containing about 3.5 micrograms per liter of chromium (VI). The potentiodynamic polarization results are presented graphically in FIGS. 13–14.

EXAMPLE 3

Chromium-Free Corrosion Inhibiting Coating on Anodized Aluminum Alloys

Figure 15:
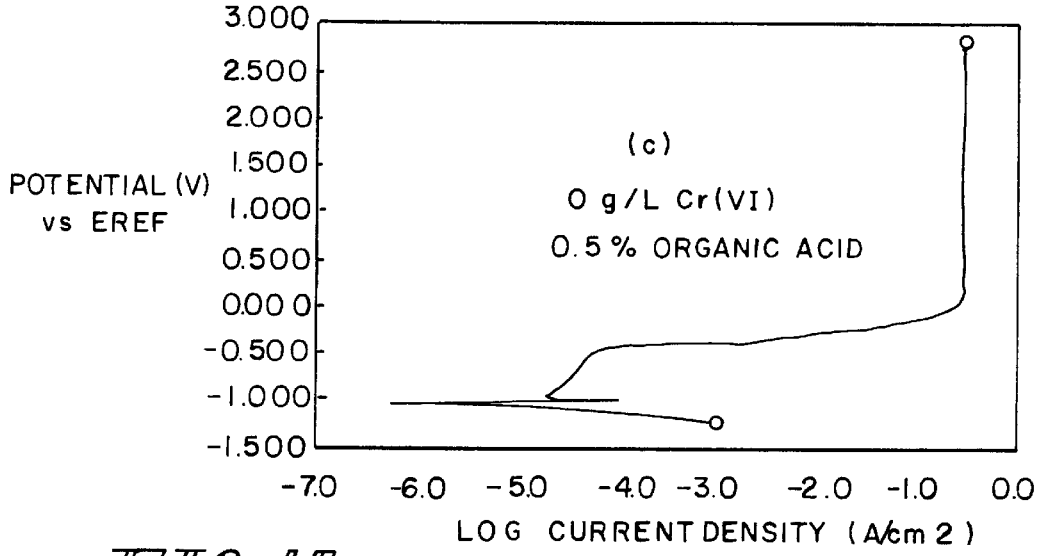
FIG. 15 is a potentiodynamic scan for an Al 6061 -T6 coupon treated with a solution containing 0.5% by volume glacial acetic acid and 3.75 grams per liter permanganate in a 3% NaCl solution (pH=7).
Figure 16:
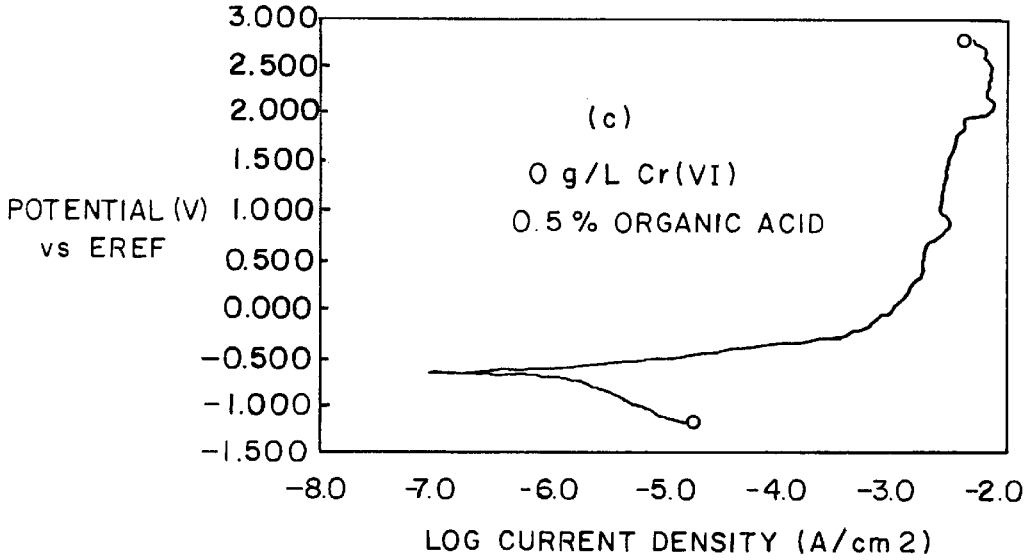
FIG. 16 is a potentiodynamic scan for an Al 2024-T6 coupon treated with a solution containing 0.5% by volume glacial acetic acid and 3.75 grams per liter permanganate in a 3% NaCl solution (pH=7).

Two Al 2024-T6 aluminum coupons and two Al 6061-T6 aluminum coupons were cleaned, degreased, and chemically polished with a solution of 75% phosphoric acid and 25% sulfuric acid. The coupons were desmutted in 1% nitric acid and then rinsed with flowing water. The coupons were anodized in 15% sulfuric acid for 15 minutes at 12 volts DC at 25° using an HP 644B D.C. power supply. One coupon of each pair was then treated with a sealing solution containing 3.75 grams per liter of permanganate and 0.5% by volume glacial acetic acid. The remaining coupon of each pair was treated with a sealing solution containing 3.75 grams per liter of permanganate and 0.25% by volume glacial acetic acid. Each of the anodized aluminum coupons was treated with the particular solution for five minutes at 100° C. to provide "sealed anodixed aluminum coupons." The sealed anodized coupons were rinsed in flowing water then air dried. The corrosion inhibition efficiency, %I.E., was evaluated by potentiodynamic polarization according to the procedure described in ASTM G3-89 "Standard Practice for Conventions Applicable to Electrochemical Measurements in Corrosion Testing" in 3% NaCl solution at pH=7. An EG&G flat cell model K 0234 was used as the corrosion cell, and a Gamry CMS 100 system along with CMS 105 software were used to derive the computer-driven polarization studies. The exposed surface area of each sample was 1 $cm^2$. A saturated calomel electrode (SCE) was used as the reference electrode while a platinum grid electrode was used as the counter electrode. The solutions were deaerated by bubbling oxygen-free nitrogen gas through the solutions The current densities were determined graphically according the Tafel extrapolation method described in ASTM G3-89. The results of the electrochemical measurements are tabulated in Table 3. The potentiodynamic polarization results for the coupons treated with the 0.5% acetic acid solution are presented graphically in FIGS. 15 and 16.

Although the present invention has been shown and described in detail, the same is as an example only and is not a limitation on the scope of the invention. Numerous modifications will be apparent to those of ordinary skill in the art based on the foregoing discussion. Accordingly, the scope of the invention is to be limited only by the terms of the appended claims.

TABLE 1

Results of Potentiodynamic Polarization Tests on Different Alloys in 3% NaCl Solution

| | | CHROMIUM (VI) CONTENT (per Liter) | | | | | | | | | | | |
|---|---|---|---|---|---|---|---|---|---|---|---|---|---|
| | | 0 g | | | 0.35 μg | | | 3.5 μg | | | 0.175 g | | |
| Sample | pH | $i_{corr}$ (μA/$cm^2$) | $E_{corr}$ (mv vs SCE) | % I.E. | $i_{corr}$ (μA/$cm^2$) | $E_{corr}$ (mv vs SCE) | % I.E. | $i_{corr}$ (μA/$cm^2$) | $E_{corr}$ (mv vs SCE) | % I.E. | $i_{corr}$ (μA/$cm^2$) | $E_{corr}$ (mv vs SCE) | % I.E. |
| A1 | 4 | 77.1 | −0.677 | — | 47.9 | −0.612 | 37.9 | 13.2 | −0.633 | 82.9 | 22.0 | −0.680 | 71.5 |
| 2024 | 7 | 19.1 | −0.722 | — | 13.7 | −0.647 | 28.3 | 11.7 | −0.607 | 38.7 | 12.6 | −0.687 | 34.0 |
| | 10 | 32.7 | −0.822 | — | 30.6 | −0.629 | 6.4 | 12.2 | −0.653 | 62.7 | 24.4 | −0.966 | 25.4 |
| A1 | 4 | 17.0 | −0.741 | — | 8.32 | −0.771 | 51.1 | 1.13 | −0.671 | 93.4 | 5.89 | −0.913 | 65.4 |
| 6061 | 7 | 11.8 | −0.759 | — | 3.79 | −0.820 | 67.9 | 7.91 | −0.833 | 33.0 | 2.09 | −0.793 | 82.3 |
| | 10 | 18.6 | −1.014 | — | 3.27 | −0.755 | 82.4 | 5.53 | −0.748 | 70.3 | 14.8 | −0.812 | 20.4 |

TABLE 2

Results of Potentiodynamic Polarization Tests for Carbon Steel in 3% NaCl Solution with Different Concentrations of Cr (VI) ions

| | CHROMIUM (VI) CONTENT (per Liter) | | | | | | | | |
|---|---|---|---|---|---|---|---|---|---|
| | 0 g | | | 3.5 μg | | | 0.175 g | | |
| Sample | $i_{corr}$ (μA/cm$^2$) | $E_{corr}$ (mV vs SCE) | % I.E. | $i_{corr}$ (μA/cm$^2$) | $E_{corr}$ (mV vs SCE) | % I.E. | $i_{corr}$ (μA/cm$^2$) | $E_{corr}$ (mV vs SCE) | % I.E. |
| Carbon Steel (with $N_2$) | 1.160 | −0.711 | — | 0.485 | −0.622 | 46.3 | 0.100 | −0.722 | 91.3 |
| Carbon Steel (with $O_2$) | 1.060 | −0.883 | — | 0.066 | −0.450 | 93.6 | 0.025 | −0.614 | 97.8 |

TABLE 3

Results of Potentiodynamic Polarization Studies in 3% NaCl Solution

| Alloy # | Organic Acid (%) | $E_{corr}$ (mV) | $I_{corr}$ (μA/cm$^2$) | I.E. (%) |
|---|---|---|---|---|
| 2024 | 0.50 | −0.647 | 0.631 | 96.70 |
| 2024 | 0.25 | −0.690 | 5.513 | 71.14 |
| 6061 | 0.50 | −1.031 | 4.329 | 63.31 |
| 6061 | 0.25 | −0.648 | 0.370 | 96.86 |

What is claimed is:

1. A composition for inhibiting corrosion of metal surfaces, said composition comprising an aqueous solution of chromium (VI) and permanganate, wherein the concentration of chromium (VI) is less than about 100 1μg/L and the concentration of permanganate is about 0.2% to about 20% by weight of the solution.

2. The composition claim 1 wherein the concentration of chromium (VI) is present in about 1 μg/L to about 80 μg/L.

3. The composition claim 1 wherein the concentration of chromium (VI) is about 5 μg/L to about 50 μg/L.

4. A method of inhibiting corrosion of a metal surface, said method comprising the step of contacting the surface with an aqueous solution comprising chromium (VI) and permanganate, wherein the concentration of chromium (VI) is less than about 100 μg/L, and the concentration of permanganate is about 0.2% to about 20% by weight of the solution.

5. The method of claim 4 wherein the metal is anodized aluminum or an anodized aluminum alloy.

6. The method of claim 4 wherein the metal is carbon steel.

7. The method of claim 4 further comprising the step of drying the metal surface.

8. The method of claim 4 wherein the metal surface is an inner surface of a conduit component of a recirculating heat transfer system and the aqueous solution is used as a heat transfer medium in said system.

9. The method of claim 4 wherein the aqueous solution is maintained at a temperature of about 90° to about 105° C.

10. The method of claim 4 wherein the metal surface is contacted with the aqueous solution for about 2 to about 60 minutes.

11. The method of claim 4 wherein the concentration of chromium (VI) is about 1 μgg/L to about 10 μg/L.

12. A metal substrate having a corrosion inhibited surface, said surface having been contacted with an aqueous solution comprising chromium (VI) and permanganate, wherein the concentration of chromium (VI) in the solution is less than about 100μg/L, and the concentration of permanganate is about 0.2% to about 20% by weight of the solution.

13. The metal substrate of claim 12 wherein corrosion inhibited surface is corrosion resistant as determined by ASTM B-117.

14. A kit for preparing a corrosion inhibiting solution for metal treatment, said kit comprising a water soluble compound of chromium (VI) and a water soluble permanganate salt wherein weight ratio of chromium (VI) to permanganate is about $1:2\times10^4$ to about $1:2\times10^8$.

15. The treatment kit of claim 14 wherein the chromium (VI) compound and the permanganate salt are premixed.

16. A composition for inhibiting corrosion of metal surfaces, said composition consisting essentially of an aqueous solution of about 0.2% to about 2.0% by volume acetic acid and about 0.2% to about 20% by weight permanganate.

17. The composition according to claim 16 wherein the amount of acetic acid is about 0.5% by volume.

18. A method of inhibiting corrosion of a metal surface, said method comprising the step of contacting the surface with an aqueous solution comprising about 0.2% to about 2.0% by volume acetic acid and about 0.2% to about 20% by weight permanganate.

19. The method according to claim 18 wherein the metal is anodized aluminum or an anodized aluminum alloy.

20. The method according to claim 18 further comprising the step of drying the metal surface.

21. The method according to claim 18 wherein the metal surface is an inner surface of a conduit component of a recirculating heat transfer system and the aqueous solution is used as a heat transfer medium in said system.

22. The method of claim 18 wherein the aqueous solution is maintained temperature of about 90° to about 105° C.

23. The method according to claim 18 wherein the metal surface is contacted with the aqueous solution for about 2 to about 60 minutes.

24. The method according to claim 18 wherein the solution contains about 0.5% by volume acetic acid.

25. A metal substrate having a corrosion inhibited surface, said surface having been contacted with an aqueous solution consisting essentially of about 0.2% to about 2.0% by volume acetic acid and about 0.2% to about 20% by weight permanganate.

26. The metal substrate according to claim 25, wherein the corrosion inhibited surface is corrosion resistant as determined by ASTM B-117.

27. A kit for preparing a corrosion inhibiting solution for metal treatment, said kit consisting essentially of acetic acid and a water soluble permanganate salt for addition to water to form a corrosion inhibiting solution containing about 0.2% to about 2.0% by volume acetic acid and about 0.2% to about 20% by weight permanganate.

* * * * *